United States Patent [19]

Dingess

[11] Patent Number: 4,787,999

[45] Date of Patent: Nov. 29, 1988

[54] COMPOSITIONS FOR CLEANING ALUMINUM

[75] Inventor: John A. Dingess, Wheeling, Ill.

[73] Assignee: Safety-Kleen Corp., Elgin, Ill.

[21] Appl. No.: 910,873

[22] Filed: Sep. 22, 1986

[51] Int. Cl.[4] ..... C11D 7/06; C11D 7/26; C11D 7/60

[52] U.S. Cl. ..... 252/174.17; 252/156; 252/173; 252/174.19; 252/174.21; 252/DIG. 14; 134/40

[58] Field of Search ..... 252/156, 89.1, 173, 252/DIG. 14, 174.17, 174.19, 174.21; 134/40

[56] References Cited

U.S. PATENT DOCUMENTS

| | | | |
|---|---|---|---|
| 3,852,209 | 12/1974 | Hoffmann | 252/95 |
| 4,477,290 | 10/1984 | Carroll et al. | 148/6 |
| 4,613,449 | 9/1986 | Dingess | 252/174.17 |

FOREIGN PATENT DOCUMENTS

| | | |
|---|---|---|
| 164476 | 8/1955 | Australia . |
| 1065730 | 11/1979 | Canada . |
| 682561 | 8/1979 | U.S.S.R. . |

*Primary Examiner*—Prince E. Willis

*Attorney, Agent, or Firm*—Lockwood, Alex, FitzGibbon & Cummings

[57] ABSTRACT

An aluminum cleaning composition and method of cleaning aluminum cooking articles. The composition comprises 0.6 to 3.5 parts by weight of a strong alkali metal hydroxide, from about 0.08 to 0.2% of calcium ion, from about 0.2 to about 3.0 parts by weight of sucrose, 0.5 to 1.5 parts by weight of citrate ion from sodium citrate, and up to about 5% of an organic anti-foaming agent. A surfactant, preferably nonionic, may be added to or used with the composition.

7 Claims, No Drawings

COMPOSITIONS FOR CLEANING ALUMINUM

BACKGROUND OF THE INVENTION

The present invention relates generally to chemical compositions, and more particularly, to specialty cleaning compositions which are useful in difficult applications, particularly those of cleaning cooking pots, pans and food service utensils.

It is well known that cooking utensils, such as pots, pans and flatware are soiled in use by a great variety of naturally occurring products which are difficult to remove. For example, during the time when a pot or kettle is used in kitchen service, it may, through ordinary use, oversight or neglect, accumulate numerous layers of baked-on, carbonized grease, protein material, and other decomposition products of food. In restaurant use, cooking pots and pans as are exposed to high temperatures for long periods of time, and are used to cook a large variety of products. These include meats, fats of various kinds, and fruits and vegetables. Such products, in turn contain not only proteinaceous material, but certain enzymes as well. Common foods also includes sugars, starches, and salts of various kinds.

When used continually, utensils are also exposed to spices and seasonings, various salts, and acids and bases. These include, for example, citric and other acids from fruits, various esters and alcohols, and certain relatively complex materials including dyes or dyelike compounds. Over a period of time, the residues of these compositions become hardened and baked on to the pans. The removal of such residues is very difficult because the compositions are no longer simply oils and greases which can be removed by conventional soaps.

In commercial food service, such as restaurant hotel, and catering operations, it is simply not practical to analyze the nature of each separate utensil stain or other residue, and consider the underlying substrate before attempting to clean it. Thus, various individual stains can be removed from most known kinds of cooking utensils by simple abrasive scrubbing, certain other materials may be removed by relatively long soaking, and still others may be treated by stronger, relatively rapidly acting chemicals. However, many compositions which are very effective against some stains are not considered safe for use with aluminum, a common constituent of food service utensils.

Other compositions are not desired for use with resin (commonly polymeric tetrafluoroethylene "TFE") coated products, while still others are considered damaging to stainless steel or copper. With the limited training facilities available for kitchen help, and with the need for speed and efficiency of cleaning, it is not uncommon for kitchen help not to differentiate among the materials from which various cooking utensils are made, and consequently either to fail to clean them effectively, or use cleaners which are adapted to clean one type of substrate but which are ineffective, or sometimes actually dangerous to others.

In particular, while there has always been and continues to be a strong need and demand for effective restaurant or other commercial cookware cleaners, there has heretofore been a lack of a suitable cleaning composition which is highly effective with both steel and aluminum, without being damaging to either.

Extended soaking is a very effective way of softening most cooking residues and dissolving them away, is not labor-intensive, and is simple. However, until the present, cleaners which are simple and safe for cooking residue have not been suitable for long term soaking of both aluminum and steel.

Many of those cleaners which were strong enough to soften deposits on steel actually attacked aluminum and dissolved it to the point where such cleaners could not be used. Other aluminum cleaners were generally not satisfactory for safe long-term soaking of aluminum, and were required to be watched and timed carefully to avoid damage. Alkali cleaners, because of their ability to saponify greases and oils, are highly desirable, but ordinarily attack aluminum in the absence of effective inhibitors. Inhibitors such as phenols, potassium salts of permanganates and chromates, are effective chemically but create problems of toxicity and color residue. Other compositions have further drawbacks, such as generating foam, or allowing redeposition of cleaned materials. Some inhibitors have been successful, such as those identified in my U.S. Pat. No. 4,613,449, but these inhibitors sometimes tend to form a gel or become unduly thick when not continually agitated. Moreover, there is still room for improvement generally in these compositions.

Consequently, there is and has been a demand for corrosion inhibitor systems which are non-toxic, which are safe in an environment surrounding food preparation and serving, and which will clean steel and/or iron, but yet not damage aluminum utensils, even after considerable time, and which possess improved corrosion inhibitors and displays desirable non-gelling characteristics.

According to the present invention, a cleaning system is provided which uses a relatively strong alkali, and a broad-spectrum inhibitor system comprised of a simple sugar, a calcium donor, sodium citrate, and an organic, nonionic antifoaming agent. The prior art having failed to provide an effective, strong cleaner which will remove cooking residues and yet not affect aluminum adversely, even upon relatively long soaking, it is an object of the present invention to provide an improved cleaner which is safe in food service environments and which include strong, long-term corrosion inhibitors to provide safety in use with aluminum.

Another object of the invention is to provide an aluminum cleaner and improved corrosion inhibitor system which is adapted for use in a commercial kitchen environment.

Yet another object of the invention is to provide a commercial cleaning system for food service articles which is economical to produce, and easy and long-lasting in use.

A further object of the invention is to provide a composition for cleaning cooking utensils which includes water, a strong base, together with an inhibiting system consisting of a simple sugar, sodium citrate, a calcium salt, and an anti-foaming additive.

A still further object of the invention is to provide an improved method of cleaning pots, pans and the like by immersing them totally over a long period in a solution containing materials adapted to attack stains and cooking residues on cookware without adversely affecting the aluminum from which the cookware is made.

Another object of the invention is to provide a highly effective aluminum cleaner and brightener which includes an inhibitor system which provides improved performance in respect to prior art calcium-sucrose inhibitors but which requires the use of far less sucrose to obtain equal or better results in use.

The foregoing and other objects and advantages of the inventions are achieved and practiced by providing a cleaner which includes, by weight, about forty to one hundred parts of water, 1 to 5 parts by weight of a strong caustic, 0.1 to 0.3 parts of calcium salt, 0.1 to 0.3 parts sucrose or like sugar, and 1.0% to 2.0% sodium citrate and up to 5.0 parts of a nonionic antifoaming additive. A nonionic or other surfactant, such as, an alkylphenyl polyethyleneglycol ether may be added, if desired.

The manner in which the present invention achieves the foregoing and other objects will become more clearly apparent when reference is made to the following detailed description of the preferred embodiments of the invention set forth by way of particular example herein.

DESCRIPTION OF THE PREFERRED EMBODIMENTS OF THE INVENTION

In order to demonstrate the effectiveness of the invention, it was first desired to establish so-called baseline which was indicative of aluminum corrosion in the presence of a strong caustic.

Accordingly, aluminum coupons were cut from aluminum stock having a thickness of 0.012 inches, mill finish and further identified as aluminum alloy T-1100, H-14. These coupons measured 5 cm by 5 cm, providing a total surface area (both sides) of 50 square centimeters. These coupons were weighed and placed in the cleaning solution summarized in Table 1, below, to simulate a soaking type of cleaning that would take place in a restaurant. Steel coupons were cut from cooking sheets soiled with baked-on carbon and grease, and were also placed in the solutions with the aluminum coupons.

After the elapse of a given time, the aluminum coupons were removed from the solution, rinsed with clear water, dried and weighed.

Standards of Corrosion With Caustic

Where soaking took place for four hours, at about 20° C., in an uninhibited solution made of 3% KOH by weight, the aluminum coupons in question had lost 14.1% by weight. This established the baseline or relative corrosion rate which was given an arbitary index number of 100, that is, a standard rate at which such aluminum was dissolving in a 3% KOH solution at 20° C.

Use of Prior Inhibitor

Next, an aqueous solution of 3% KOH was prepared and provided with an inhibitor solution giving 2.7% by weight of sucrose in the final solution and calcium chloride in a ratio of 1.0, part $CaCl_2$ to 2.59 parts sucrose. The loss of aluminum by weight percent was 0.15; this established a corrosion rate of substantially about 1, that is, the inhibitor reduced the corrosion rate by two orders of magnitude or about 100 times.

Next, an inhibitor system giving 1.5% by weight of sodium citrate in the final solution and calcium oxide in a ratio of 1.0 parts CaO to 50 parts sodium citrate was provided. Under the same conditions, this resulted in an actual percentage weight loss of 1.67%. This corrosion rate was about 10, or 11, or approximately 9 or 10 times better than uninhibited solution, but of some 10 or more times worse than the inhibited solution described just above.

Finally, an inhibitor was prepared using, in combination, 1/10 of the amount of sucrose/calcium chloride previously employed, that is, 0.27% by weight of sucrose in the final solution, which amount was used in conjunction with the 1.5% sodium citrate/calcium oxide solution described in the immediately preceding paragraph. When tested under the same conditions, aluminum showed a weight loss of 0.22% in four hours, or a relative corrosion rate of about 1.5. From the foregoing, it will be seen that decreasing the amount of sucrose/calcium chloride inhibitor present by an entire factor of 10, or an entire order of magnitude, and then combining this with the citrate CaO inhibitor, a very satisifactory corrosion rate was able to be achieved. The foregoing performance may be summarized in tabular form as follows:

TABLE 1

| Solution Type | Actual % wt. loss of Al | Relative Corrosion Rate |
|---|---|---|
| Example A | | |
| Blank - 3% KOH | 14.1 | 100 |
| Example B | | |
| 3% KOH, 2.7% sucrose, 1% $CaCl_2$ | 0.15 | 1 |
| Example C | | |
| 3% KOH, 1.5% NaCitrate, 0.03% CaO | 1.67 | 10 |
| Example D | | |
| Composite Solution - 3% KOH; 1 part inhibitor as per Example C; 0.1 part inhibitor as per Example B | 0.22 | 1.5 |

Other solutions, were made using KOH in percentages of from about 2% to about 4%, and utilized the inhibitor combination of Example D. These were found satisfactory, but the composition using 3% KOH was preferred for most applications.

In Example D. the inhibitor used contained 10 parts of the Example C inhibitor for every part of Example B inhibitor. This ratio may be varied from somewhat less than 4 or 5 to 1 up to 12 or more to 1, but the 10 to 1 ratio illustrated in Example D is presently preferred.

The use of certain sugars, including sucrose, glucose, and fructose, as components of electrolytic sodium hydroxide solutions using aluminum as an anode has been reported, particularly in connection with substantial plating currents, and such sugars are recognized as assisting in corrosion reduction. However, no teachings are known which relate to the combined use of sugars, caustics, soaps, and defoamers in grease and oil type cleaning environments.

Referring to another aspect of the invention, the material is very favorable from the standpoint of not requiring vigilance in use. In the past, certain other cleaners tended to foam excessively, creating damage to the environment or indicating dissolution of aluminum. While a certain amount of foaming is desirable for removal and floating to the surface of impurities to prevent redeposition, a very slight foam only is found present in the preferred use of the invention. Consequently, contract workers or professional cleaners may advise kitchen workers merely to immerse the materials to be cleaned in a soaking tank with the confidence that no adverse reaction resulting in the generation of foam or the like will occur and create damage or inconvenience.

Other solutions tended to thicken or gel, especially with non-use over a period of time. A major advantage of the present invention is thus its safety and ability to be used effectively by unskilled labor, not to require continual vigilance in use, and to be free of gelling or thickening when the inhibitor is present in effective amounts.

It will thus be seen that the present invention provides novel compositions and methods for removing soils and stains from cookware, including aluminum and iron and steel cookware in the presence of each other, such compositions and methods having a number of advantages and characteristics, including safety ease of use and other characteristics referred to in the foregoing specification.

Various examples of practicing the invention having been set forth by way of example, it is anticipated that variations to the described examples will occur to those skilled in the art, and that variations to the described form of invention may be made without departing from the spirit of the invention or the scope of the appended claims.

I claim:

1. An aluminum cleaning composition comprising, in combination, from about 0.6 to 3.3 parts by weight of a strong alkali metal hydroxide, from about 0.08 to about 0.18% of calcium ion from a calcium ion donor, from about 0.2 to about 3.0 parts by weight of sucrose, from about 0.5 to about 1.5 parts by weight of a citrate ion from sodium citrate, and up to about 5% of an organic antifoaming agent, with the balance being water.

2. An aluminum cleaning composition as defined in claim 1 wherein said alkali metal hydroxide concentration is from 2 to 4%.

3. An aluminum cleaning composition as defined in claim 1 wherein said organic antifoaming agent is a nonionic antifoaming agent.

4. An aluminum cleaning composition as defined in claim 1 which further includes a nonionic surfactant.

5. An aluminum cleaning composition as defined in claim 1 wherein said alkali metal hydroxide material is potassium hydroxide.

6. A method of cleaning an aluminum surface encrusted with cooked on grease, oil and protein residues, said method comprising immersing an article so coated into a solution comprising from about 0.6 to about 3.3 parts by weight of a strong alkali metal hydroxide, from about 0.08 to about 0.18% of calcium ion from a calcium ion donor from about 0.2 to about 3.0 parts by weight of sucrose, from about 0.5 to about 1.5 parts by weight of a citrate ion from sodium citrate, and up to about 5% of an organic antifoaming agent, with the balance being water, exposing the coated surface to said composition for from about 1 hour to about 24 hours, and removing the article from said solution.

7. An aluminum cleaning composition as defined in claim 4 wherein said surfactant is an alkylphenyl polyethylene glycol ether.

* * * * *